United States Patent [19]

Hamner

[11] Patent Number: 5,033,266

[45] Date of Patent: Jul. 23, 1991

[54] OVERCENTER VALVE CONTROL SYSTEM AND METHOD FOR DRILLING

[75] Inventor: Jeffrey W. Hamner, Allen, Tex.

[73] Assignee: Ingersoll-Rand Company, Woodcliff Lake, N.J.

[21] Appl. No.: 398,414

[22] Filed: Aug. 25, 1989

[51] Int. Cl.[5] ..... F16D 31/02

[52] U.S. Cl. ..... 60/460; 71/420

[58] Field of Search ..... 60/460, 461, 466; 91/420, 445

[56] References Cited

U.S. PATENT DOCUMENTS

| | | | |
|---|---|---|---|
| 2,153,056 | 4/1939 | West . | |
| 2,285,069 | 6/1942 | Vickers | 60/461 |
| 2,457,467 | 12/1948 | Hartman . | |
| 2,654,998 | 10/1953 | Naylor et al. | 60/460 |
| 3,283,668 | 5/1965 | Johnson et al. . | |
| 3,747,351 | 7/1973 | Wilkerson et al. . | |
| 3,864,911 | 2/1911 | Gellatly et al. . | |
| 4,569,272 | 2/1986 | Taylor et al. | 91/420 |
| 4,732,076 | 3/1988 | Ewald | 91/420 |

*Primary Examiner*—Edward K. Look

*Assistant Examiner*—F. Daniel Lopez

*Attorney, Agent, or Firm*—Glenn B. Foster

[57] ABSTRACT

A drill feed control system for controlling the force exerted on a drill string having substantial weight. A feed cylinder, which has a first end and a second end, is connected to the drill string. Fluid is pumped from a reservoir to displace the feed cylinder. A first conduit is connected to the first end while a second conduit is attached to the second end. A variable displacement pump displaces fluid from the reservoir, within the first conduit, to the first end of the feed cylinder. A feed pressure control regulates the pressure of the variable displacement pump. An overcenter valve, which is connected to the second conduit, restricts the fluid exiting the second conduit. A relief valve controls the flow of fluid to a pilot conduit which extends between the first conduit and the overcenter valve. An orifice or check valve to release the pressure is connected to the pilot conduit such the the pressure in the pressure conduit will respond to a pressure increase or decrease in the first conduit. The pressure in the pilot conduit and the second conduit interact to open the overcenter valve.

19 Claims, 5 Drawing Sheets

OVERCENTER VALVE CONTROL SYSTEM AND METHOD FOR DRILLING

BACKGROUND OF THE INVENTION

This invention relates generally to an overcenter valve, and more particularly to a valve which may be precisely operated to control the feed force for a drill.

FIGS. 1 and 2 show the prior art pertinent to the instant invention. Displacement of a cylinder 10 causes motion in drill string 14, as is well known in drilling operations. A variable displacement pump 16 supplies the fluid to operate the feed cylinder 10 via a four way valve 18 and a first conduit 20.

The four way valve 18 controls the direction of flow of the fluid which is supplied to the feed cylinder 10. A feed pressure control 22 affects the pressure at which the pump 16 acts. A reservoir 17 contains the hydraulic fluid which is used by the pump 16 in extending the feed cylinder 10.

While the first conduit 20 is in fluid communication with a first end 26 of the feed cylinder 10, an overcenter valve 24 is in fluid communication with a second end 27 of the feed cylinder 10 via a second conduit 28. The overcenter valve 24 (also known as a counterbalance or a holding valve) effects the change in feed force exerted by the feed cylinder 10 as a certain feed pressure is exerted by the pump 16. A graph for this relationship is shown in FIG. 2.

The feed pressure required to open the overcenter valve 24 can be adjusted by a set spring 25. The two pressures interacting to open the valve 24 are the pressure exerted through a second conduit 28, and the pressure exerted through a pilot line 30 which is directly connected to the first conduit 20.

When overcenter valve 24 opens, fluid in a second conduit 28 is permitted to travel through the valve. An initial gradient 46 in the FIG. 2 feed force v. feed pressure graph, occurs as the valve 24, is holding pressure against the cylinder 10 rod end 27. A shallower gradient 48 occurs when the valve 24 opens due to the influence of pressure in 30 alone, so that no hold back pressure at 28 is generated.

The steeper the gradient of the graph, the less the change in feed pressure (as controlled by the operator) being necessary to produce a similar change in the feed force. In other words, the feed force is more sensitive to changes in the feed pressure. This situation can be analogized to an inexpensive transistor radio in which a minor change in the volume control produces an excessive change in the volume of the radio.

When starting to drill a hole, a small, controllable feed force is desirable to assure the hole gets started straight. Excessive downward force when starting a hole can result in a crooked hole and/or severe strain in the drill string 14 attached to the feed cylinder 10. It is thus greatly preferable to be able to more precisely control the feed force by a change in the feed pressure than occurs in the prior systems.

The forgoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a drill feed control system comprising a feed cylinder having a first end and a second end. A first conduit is connected to the first end and a second conduit is connected to the second end. A reservoir is included in the drill feed control system. Variable displacement pump means displace fluid from the reservoir to the first end of the feed cylinder. Feed pressure control means control the pressure applied from the variable displacement pump. An overcenter valve is in fluid communication with the second conduit. A pilot conduit communicates fluid in the first conduit to the overcenter valve. Pilot conduit pressure control means hold pressure in the pilot conduit constant for a predetermined range of variable displacement pump pressures, and increase the pilot conduit pressure at a controlled rate for increases of the variable displacement pump pressures above the predetermined range.

The forgoing and other aspects will become apparent from the following detailed description of the invention when considered in conjunction with the accompanying drawing. It is to be expressly understood, however, that the drawing figures are not intended as a definition of the invention, but are for the purpose of illustration only.

DETAILED DESCRIPTION

Figure 1:
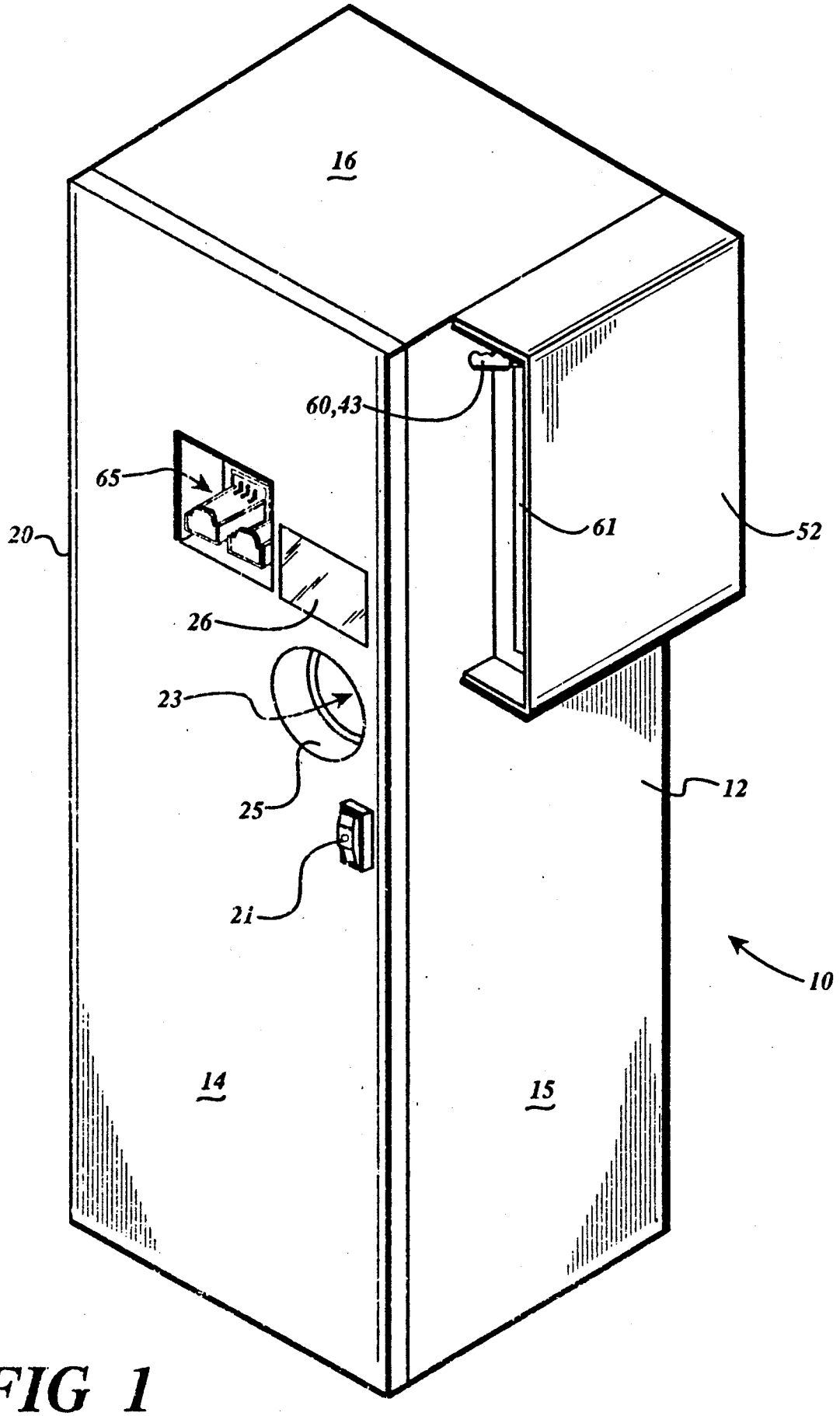
FIG. 1 is a schematic view illustrating the drill feed regulated control system of the prior art, with the portion which is modified by the instant invention shown encircled in phantom.
Figure 2:
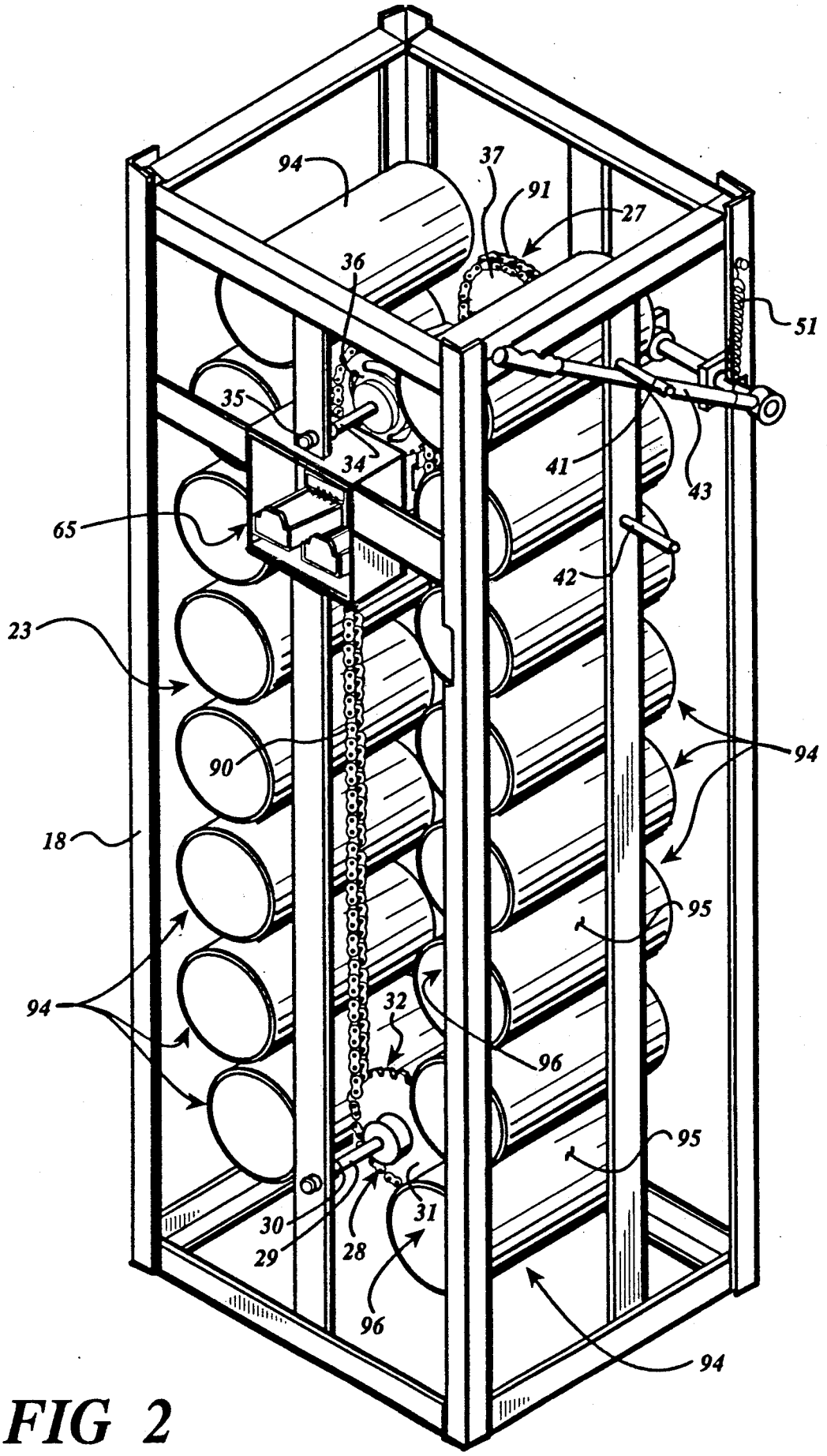
FIG. 2 is a graph displaying the feed force exerted by the feed cylinder as a function of the feed pressure exerted by the pump of the prior art system as described in FIG. 1.
Figure 3:
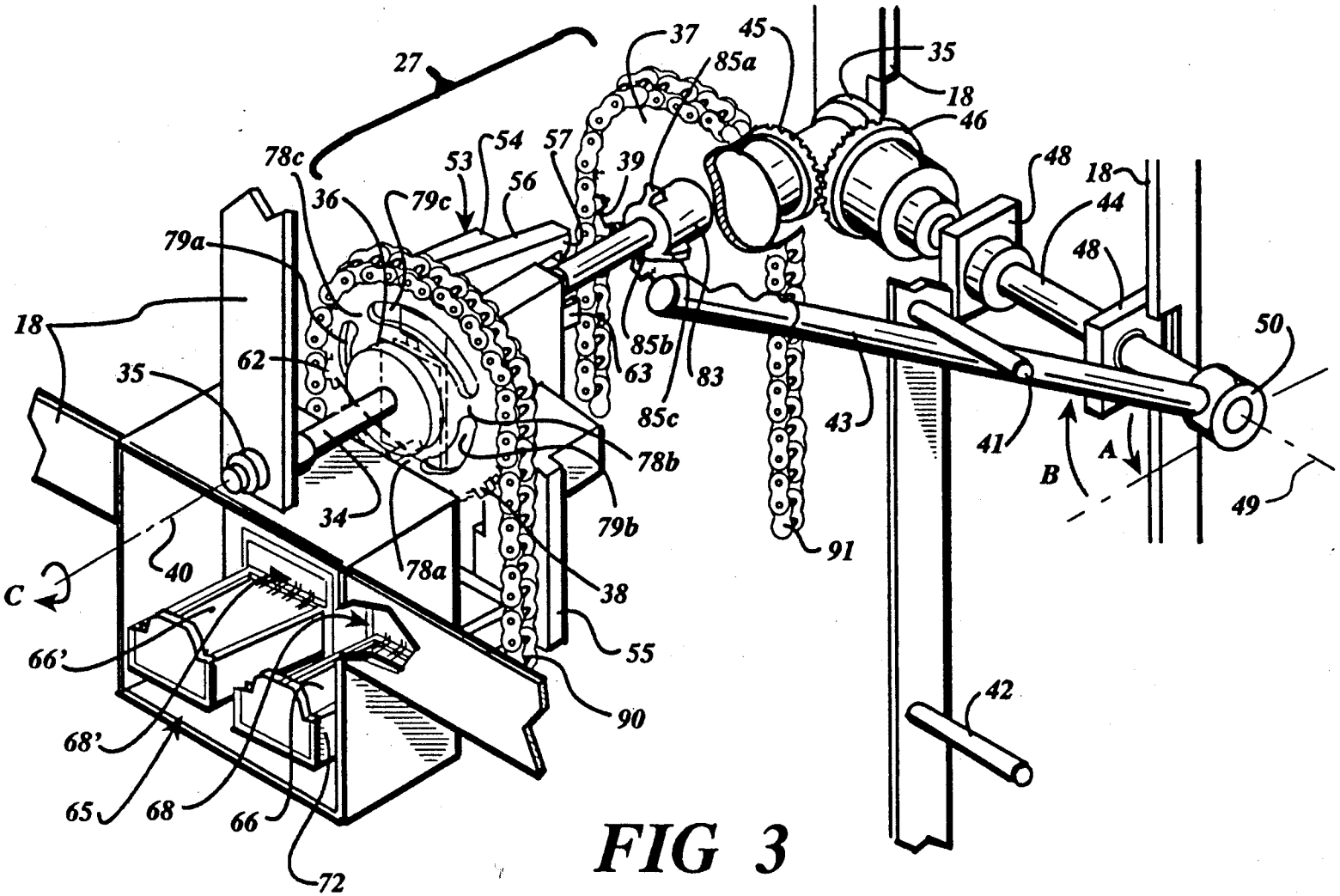
FIG. 3 is a schematic view illustrating one embodiment of the modified encircled portion of the FIG. 1 drill feed regulating control system of the instant invention.

Referring now to the drawings, FIGS. 3, 4, 5 and 6 illustrate embodiments of the control system for an overcenter valve of the instant invention. Similar elements to those existing in FIGS. 1 and 2, as described in the background of the instant invention, are similarly numbered throughout.

A relief valve 32, which may be adjusted by a relief valve pressure setting 34, controls the pressure at which the valve 32 permits pressure from the first conduit 20 to enter a pilot line or conduit 30. The pressure in the pilot conduit 30 interacts with the pressure in the second conduit 28 to open the overcenter valve 24. The pressure in the pilot conduit 30 responds to, but often is not identical with the pressure in the first conduit 20, as follows.

Once the relief valve 32 opens by the first conduit 20 pressure meeting the relief valve pressure setting 34, the pressure in the pilot conduit 30 is increased. However, the pressure in the first conduit 20 will remain greater than the pressure in pilot conduit 30 by the relief valve pressure setting 34 which depends upon the physical configuration of the valve 32.

A relief orifice 36 permits a slow flow of fluid in the pilot conduit 30 to escape from the pilot conduit. This amount of fluid can easily be replaced by the pump 16. The relief valve and orifice interact to keep the pressure in the pilot conduit 30 responsive to the pressure change in the first conduit 20. The pressure in the pilot conduit 30 thus will not remain excessive after the pressure in the first conduit 20 has dropped.

Figure 5:
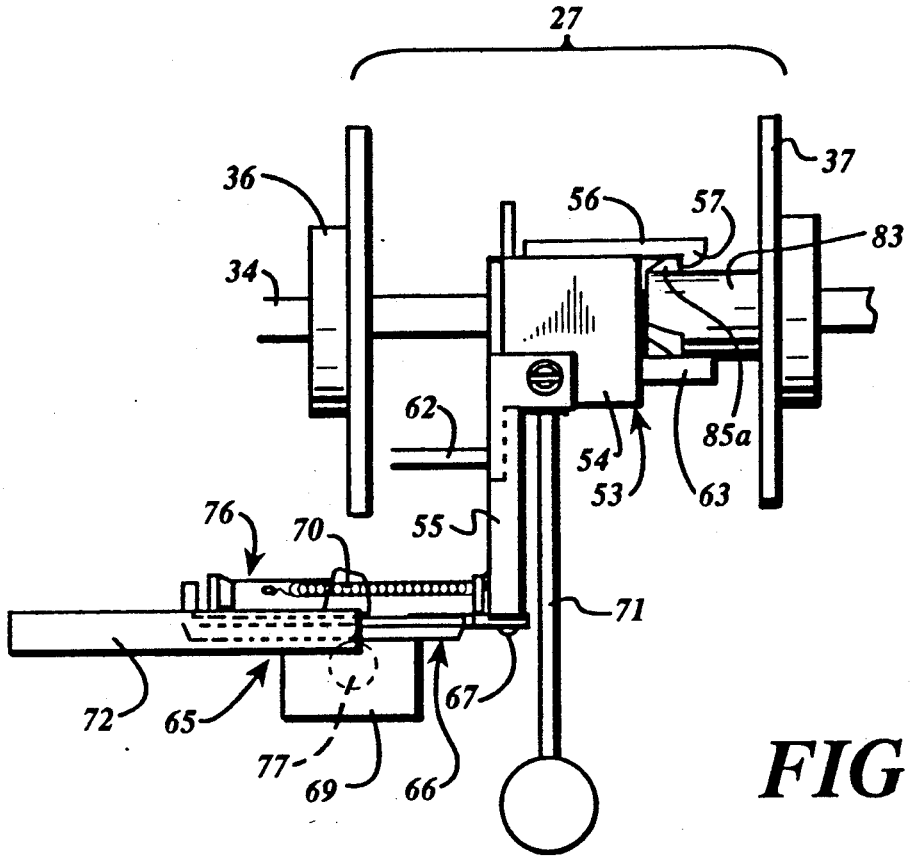
FIG. 5 is a schematic diagram illustrating another, but similar, modified portion embodiment of a drill feed regulating system from that described in FIG. 3.

In another embodiment, shown in FIG. 5, a check valve 38 is connected between the pilot conduit 30 and the first conduit 20. The check valve 38 will release fluid from conduit 30 when the pressure in the pilot conduit 30 equals or exceeds the pressure in the first conduit 20. This is another device which keeps the pressure change in the pilot conduit 30 responsive to pressure in the first conduit 20.

Figure 6:
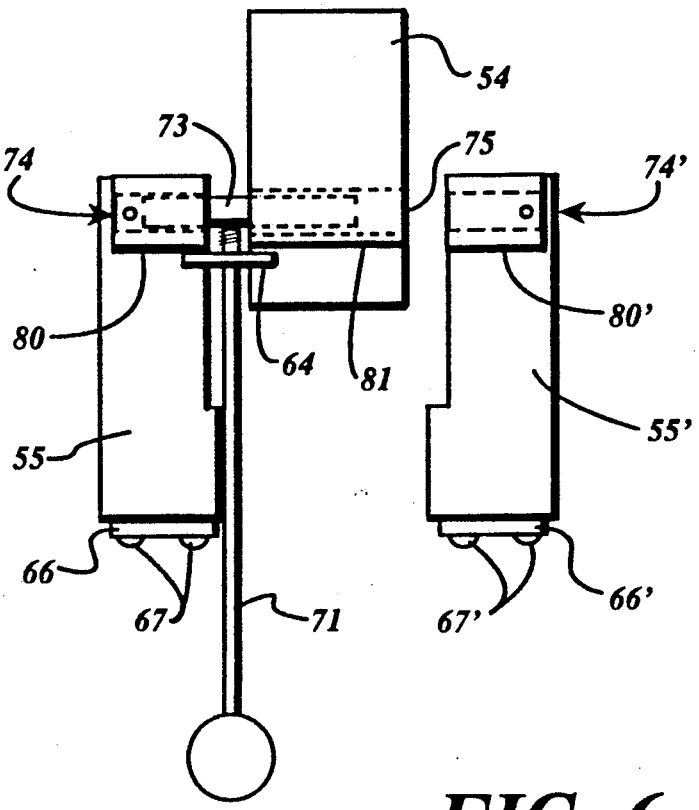
FIG. 6 is a schematic diagram illustrating yet another modified encircled embodiment portion of the FIG. 1 drill feed regulating system of the instant invention.
Figure 1:
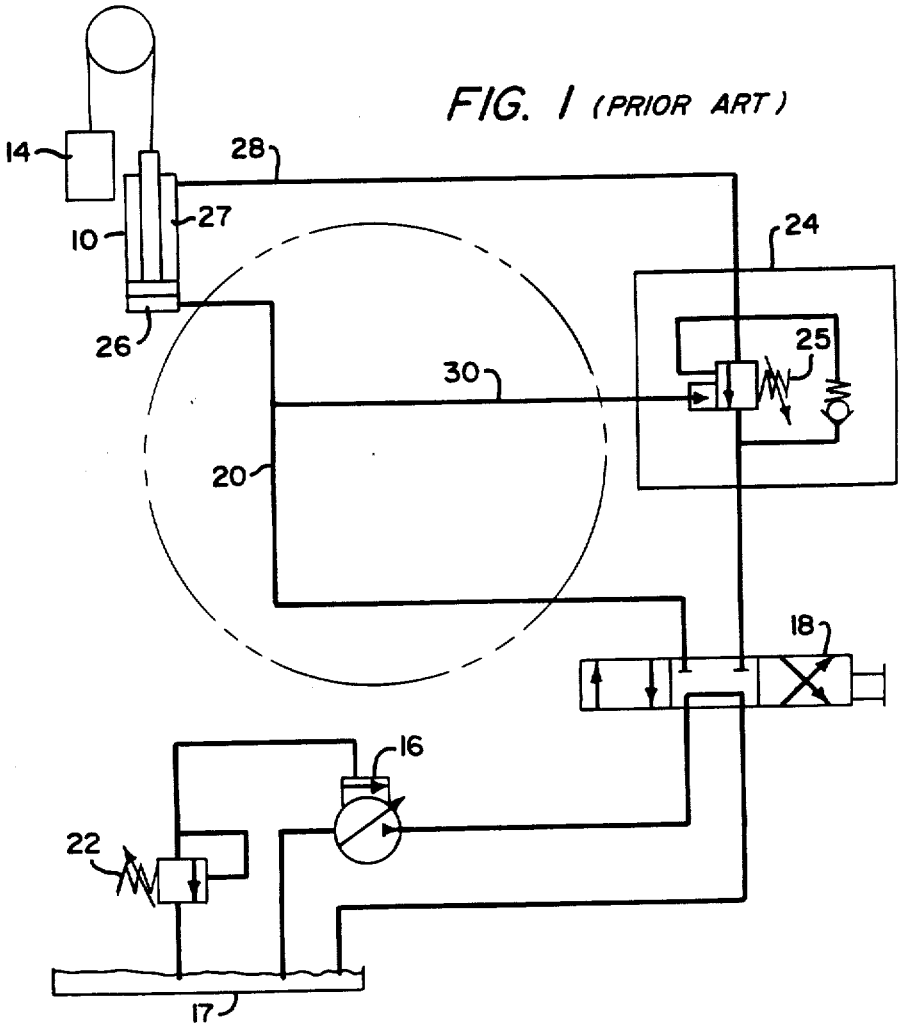
FIG. 1 (PRIOR ART)
Figure 2:
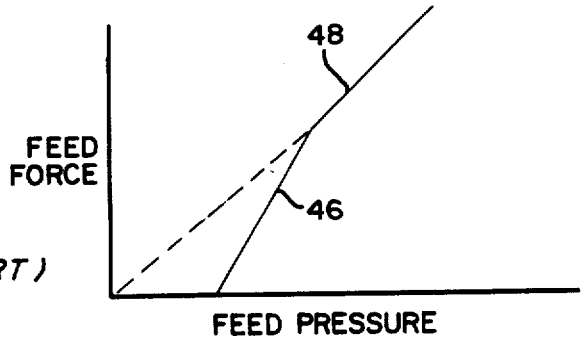
FIG. 2 (PRIOR ART)
Figure 3:
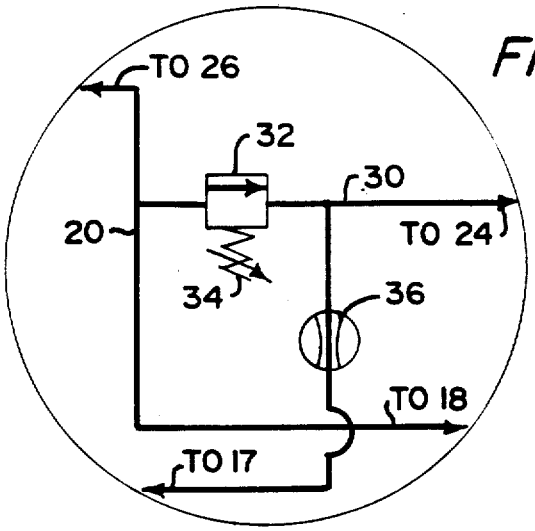
Figure 4:
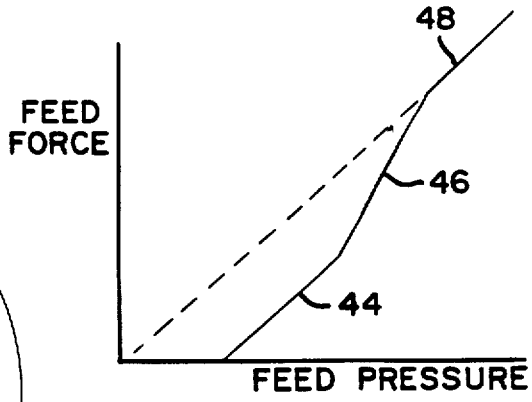
Figure 5:
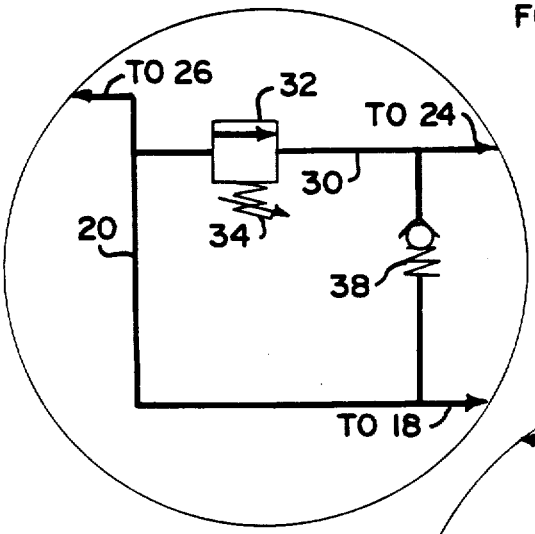
Figure 6:
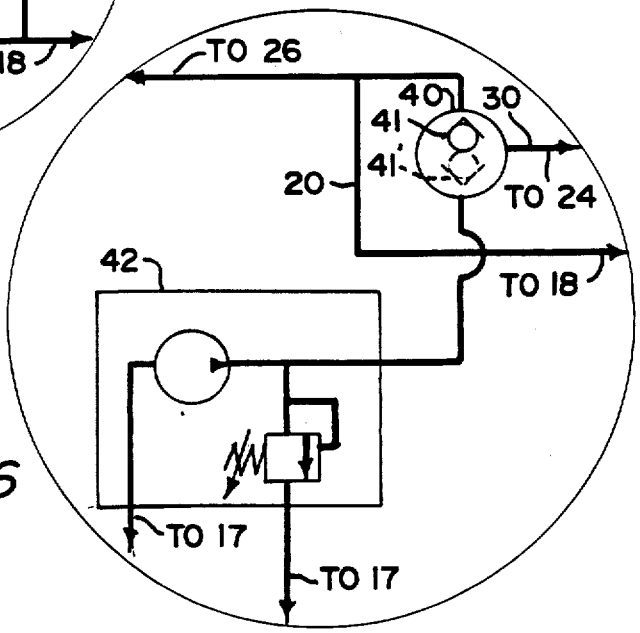

In yet a third embodiment of this invention, as shown in FIG. 6, a shuttle valve 40 is utilized to control the pressure in the pilot conduit 30. A remote constant pressure source 42 supplies a constant pressure to the pilot conduit 30, and seals off the pressure in the first conduit 20 by valve sealing member 41 until such time as t he pressure in the first conduit 20 exceeds the pressure in the constant pressure source 42. When the first conduit 20 pressure exceeds the constant pressure source 42 pressure, the sealing member 41 in shuttle valve 40 will be displaced downward into position 41' to seal off the constant pressure source 42, and the pressure in the pilot conduit 30 will equal the pressure in the first conduit 20. While the pilot conduit pressures in this embodiment will usually exceed the pressures in the previous embodiments, the feed force vs feed pressure graph will display a similar outline to the prior embodiments, and this embodiment will display similar precise control of feed force by affecting feed pressure to that displayed in the previous embodiments.

The two characteristics which are shared by all of the above embodiments to the instant invention are:

1) The pilot pressure is held constant for a predetermined range of system feed pressures.

2) At pressures above the aforementioned feed pressure range, the pilot pressures will increase at a predetermined threshold and a controlled rate.

The relief valve 32 does not open at all until the pressure setting 34 is reached. Before the valve 32 opens, the only pressure acting to open the overcenter valve 24 is the pressure in the second conduit 28. The gradient of the feed force vs feed pressure graph is therefor shallower than in the prior art until such time as sufficient pressure is achieved in the first conduit 20 to cause the relief valve 32 to open. The feed force of the feed cylinder 10 is in this manner more precisely controlled (in the lower feed force ranges) by altering the feed pressure in the instant invention as compared with the prior art.

In drilling applications, the lower feed force ranges (which correlate with a lower graph portion 44) are typically used for hammer drilling type operations, while the higher ranges (which correlate with a higher feed force graph portion 48) are typically used for rotary drills.

Figure 4:
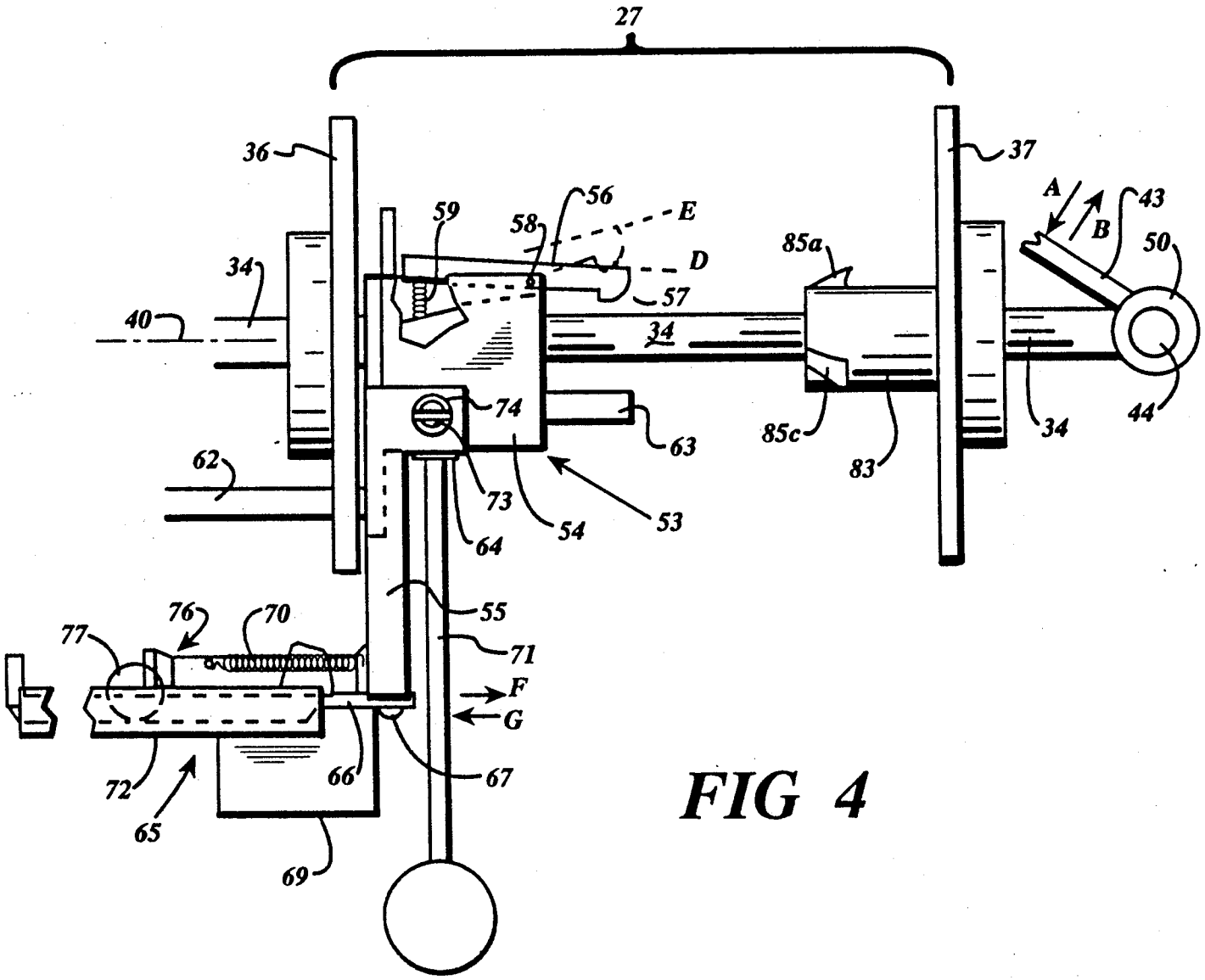
FIG. 4 is a graph displaying the feed force exerted by the feed cylinder as a function of the feed pressure exerted by the pump of the embodiment of the instant invention described in FIG. 3.

The position of a middle, steeper portion 48 of the FIG. 4 graph can be altered by changing the adjustments in the system. The operator can thus, depending upon the type of drilling which is being done, choose suitable adjustments such that the middle (and less controllable) feed force portion 48 of the graph will not be utilized when the operator is operating the drill.

While this invention has been illustrated and described in accordance with a preferred embodiment, it is recognized that variations and changes may be made therein without departing from the invention as set forth in the claims.

What is claimed is:

1. A drill feed control system, comprising:

a feed cylinder having a first end and a second end, the cylinder being in fluid communication with the drill string a first conduit in fluid communication with the first end;

a second conduit in fluid communication with the second end;

a reservoir;

variable displacement pump means for displacing fluid from the reservoir, through the first conduit, to the first end of the feed cylinder;

feed pressure control means for controlling the pressure of the variable displacement pump means;

an overcenter valve connected to the second conduit;

a pilot conduit communicating fluid in said first conduit to the overcenter valve; and a relief valve controlling pressure in the pilot conduit wherein pressure in the pilot conduit is held constant for a predetermined range of variable displacement pump pressures, said constant pilot conduit pressure being greater than a pressure in said reservoir.

2. A drill feed control system as defined in claim 1, wherein pressures in the pilot conduit and the second conduit interact to open the overcenter valve.

3. The drill feed control system as defined in claim 1, further comprising:

an orifice connected between the pilot conduit and the reservoir.

4. The drill feed control system as defined in claim 1, wherein the relief valve will open only when a threshold pressure is met.

5. The drill feed control as defined in claim 1, wherein a check valve is connected between the first conduit and the pilot conduit.

6. A drill feed control system comprising:

a drill string having substantial weight;

a feed cylinder, having a first end and a second end, the cylinder being connected to the drill string;

a first conduit connected to the first end;

a second conduit connected to the second end;

a reservoir;

variable displacement pump means for displacing fluid from the reservoir, through the first conduit, to the first end of the feed cylinder;

feed pressure control means for controlling the pressure of the variable displacement pump means;

an overcenter valve connected to the second conduit;

a pilot conduit connecting said first conduit to the overcenter valve;

a constant pressure source; and a relief shuttle valve connecting the pilot conduit to either of the first conduit and the constant pressure source.

7. A drill feed control system as defined in claim 6, wherein pressures in the pilot conduit and the second conduit interact to open the overcenter valve.

8. A drill feed control system as defined in claim 6, wherein the pilot conduit contains the pressure of whichever of the first conduit or the constant pressure source that has the higher pressure.

9. A method for precisely controlling the force of a feed cylinder, having a first and a second end comprising the steps of;

connecting a first conduit to the first end of the cylinder;

connecting a second conduit to the second end of the cylinder;

operating a variable displacement pump to generate pressure in the first conduit;

restricting flow from the second conduit with an overcenter valve;

connecting a pilot conduit between the first conduit and the overcenter valve; and connecting a relief valve between the pilot conduit and the first conduit to maintain pressure in the pilot conduit at a controllable amount below pressure in the first conduit, wherein pressure in the pilot conduit will be held constant for a predetermined range of variable displacement pump pressures.

10. A drill feed control system, comprising:

a feed cylinder having a first end and a second end;

a first conduit connected to the first end;

a second conduit connected to the second end;

a reservoir;

variable displacement pump means for displacing fluid from the reservoir to the first end of the feed cylinder;

feed pressure control means for controlling the pressure applied from the variable displacement pump;

an overcenter valve in fluid communication with the second conduit;

a pilot conduit communicating fluid in the first conduit to the overcenter valve; and pilot conduit pressure control means for holding pressure in the pilot conduit constant for a predetermined range of variable displacement pump pressures, and increase the pilot conduit pressure at a controlled rate for increases of the variable displacement pump pressures above the predetermined range, said constant pilot conduit pressure being greater than a pressure in said reservoir.

11. The drill feed control system as described in claim 10, wherein the pilot conduit pressure control means includes a relief valve.

12. The drill feed control system as described in claim 10, wherein the pilot conduit pressure control means includes a constant pressure source.

13. The drill feed control system as described in claim 10, wherein pressures in the pilot conduit and the second conduit interact to open the overcenter valve.

14. The drill feed control system as defined in claim 10, further comprising:

an orifice which fluidly communicates the pilot conduit and the reservoir.

15. The drill feed system as defined in claim 10, wherein a relief valve will remain open only when a threshold pressure is met.

16. A drill feed control system as defined in claim 10 wherein a check valve is connected between the first conduit and the pressure conduit.

17. A drill feed control system, comprising:

a feed cylinder;

first and second conduits in fluid communication with opposite ends of the feed cylinder;

reservoir means for containing fluid;

variable displacement pump means for displacing fluid from the reservoir means, through the first conduit to the feed cylinder;

feed pressure control means for controlling the pressure of the pump means;

a overcenter valve in fluid communication with the second conduit;

a pilot conduit fluidly communicating the first conduit to the overcenter valve;

a constant pressure source; and a relief shuttle valve connecting the pilot conduit to either of the first conduit and the constant pressure source.

18. The drill feed control system as described in claim 17, wherein pressure in the pilot conduit and the second conduit interact to open the overcenter valve.

19. The drill feed system as described in claim 17, wherein the pilot conduit contains pressure of whichever member has the greatest pressure between the first conduit and the constant pressure source.

* * * * *

UNITED STATES PATENT AND TRADEMARK OFFICE

CERTIFICATE OF CORRECTION

PATENT NO. : 5,033,266

DATED : July 23, 1991

INVENTOR(S) : Jeffrey W. Hammer

It is certified that error appears in the above-identified patent and that said Letters Patent is hereby corrected as shown below:

The title page, showing the illustrative figure, should be deleted and substitute therefor the attached title page.

Sheets 1-5 of the drawings, consisting of FIGS. 1-6, should be deleted to be replaced with Sheets 1 and 2, consisting of FIGS. 1-6, as shown on the attached pages.

Signed and Sealed this

Twenty-third Day of February, 1993

*Attest:*

STEPHEN G. KUNIN

*Attesting Officer*

*Acting Commissioner of Patents and Trademarks*

United States Patent [19]

Hamner

[11] Patent Number: 5,033,266

[45] Date of Patent: Jul. 23, 1991

[54] OVERCENTER VALVE CONTROL SYSTEM AND METHOD FOR DRILLING

[75] Inventor: Jeffrey W. Hamner, Allen, Tex.

[73] Assignee: Ingersoll-Rand Company, Woodcliff Lake, N.J.

[21] Appl. No.: 398,414

[22] Filed: Aug. 25, 1989

[51] Int. Cl.[5] ..... F16D 31/02

[52] U.S. Cl. ..... 60/460; 71/420

[58] Field of Search ..... 60/460, 461, 466; 91/420, 445

[56] References Cited

U.S. PATENT DOCUMENTS

| | | | |
|---|---|---|---|
| 2,153,056 | 4/1939 | West . | |
| 2,285,069 | 6/1942 | Vickers | 60/461 |
| 2,457,467 | 12/1948 | Hartman . | |
| 2,654,998 | 10/1953 | Naylor et al. | 60/460 |
| 3,283,668 | 5/1965 | Johnson et al. . | |
| 3,747,351 | 7/1973 | Wilkerson et al. . | |
| 3,864,911 | 2/1911 | Gellatly et al. . | |
| 4,569,272 | 2/1986 | Taylor et al. | 91/420 |
| 4,732,076 | 3/1988 | Ewald | 91/420 |

*Primary Examiner*—Edward K. Look

*Assistant Examiner*—F. Daniel Lopez

*Attorney, Agent, or Firm*—Glenn B. Foster

[57] ABSTRACT

A drill feed control system for controlling the force exerted on a drill string having substantial weight. A feed cylinder, which has a first end and a second end, is connected to the drill string. Fluid is pumped from a reservoir to displace the feed cylinder. A first conduit is connected to the first end while a second conduit is attached to the second end. A variable displacement pump displaces fluid from the reservoir, within the first conduit, to the first end of the feed cylinder. A feed pressure control regulates the pressure of the variable displacement pump. An overcenter valve, which is connected to the second conduit, restricts the fluid exiting the second conduit. A relief valve controls the flow of fluid to a pilot conduit which extends between the first conduit and the overcenter valve. An orifice or check valve to release the pressure is connected to the pilot conduit such the the pressure in the pressure conduit will respond to a pressure increase or decrease in the first conduit. The pressure in the pilot conduit and the second conduit interact to open the overcenter valve.

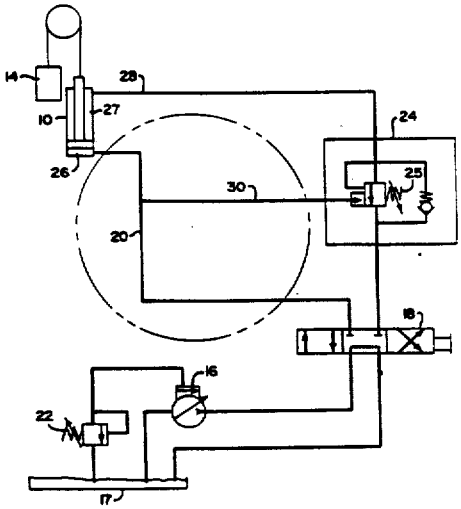

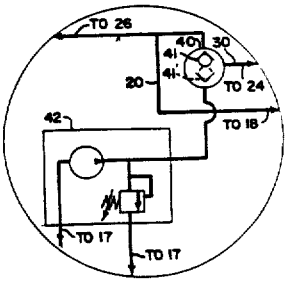

19 Claims, 2 Drawing Sheets